US005886465A

United States Patent [19]

Muramatsu et al.

[11] Patent Number: 5,886,465

[45] Date of Patent: Mar. 23, 1999

[54] PHOTOMULTIPLIER TUBE WITH MULTI-LAYER ANODE AND FINAL STAGE DYNODE

[75] Inventors: Shinichi Muramatsu; Fumihiro Takayama; Toyohiko Terada, all of Hamamatsu, Japan

[73] Assignee: Hamamatsu Photonics K.K., Hamamatsu, Japan

[21] Appl. No.: 936,900

[22] Filed: Sep. 25, 1997

[30] Foreign Application Priority Data

Sep. 26, 1996 [JP] Japan ..... 8-255067
Sep. 26, 1996 [JP] Japan ..... 8-255074
Sep. 26, 1996 [JP] Japan ..... 8-255078

[51] Int. Cl.[6] ..... H01J 43/18

[52] U.S. Cl. ..... 313/533; 313/532; 313/540

[58] Field of Search ..... 313/528, 531, 313/532, 533, 534, 535, 540, 103 CM, 105 CM

[56] References Cited

U.S. PATENT DOCUMENTS 5,572,089 11/1996 Kyushima et al. ..... 313/533
5,619,100 4/1997 Kyushima et al. ..... 313/533

FOREIGN PATENT DOCUMENTS 59-151741 8/1984 Japan .
6-314550 11/1994 Japan .

*Primary Examiner*—Vip Patel
*Attorney, Agent, or Firm*—Pillsbury Madison & Sutro LLP

[57] ABSTRACT

A photomultiplier tube of the present invention is the one which collects the electrons, which have been multiplied by the dynodes laminated into a plurality of stages in the electron multiplier section and that have subsequently been reflected at the final-stage dynode, as an output signal. The photomultiplier tube forms the final-stage dynode as multi-stage, for example, in two layers, and has its alkali metal vapor passage holes of its first layer so arranged as to have the holes shifted with respect to the alkali metal vapor passage holes of the second layer. Furthermore, each of the dynodes, except the final-stage dynode consists of the focusing mesh electrode, the coarse mesh electrode, and the spacer electrode and the reinforcing bars are formed at identical locations in the coarse mesh electrode and the spacer electrode. Secondary electron emission sections are provided in the vicinity regions of these reinforcing bars of the focusing mesh electrodes.

14 Claims, 12 Drawing Sheets

PHOTOMULTIPLIER TUBE WITH MULTI-LAYER ANODE AND FINAL STAGE DYNODE

BACKGROUND OF THE INVENTION

1. Field of the Invention

The present invention relates to a photomultiplier tube, more particularly to a large-size photomultiplier tube that multiplies electrons incident on an electron multiplier section by laminated multi-stage dynodes.

2. Related Background Art

Conventionally, a photomultiplier tube of this kind which is described in Japanese Patent Application Laid Open No. 59-151741 has been known. This photomultiplier tube comprises a photoelectric surface formed on one end of a cylindrical blind vacuum container, an electron multiplier section that has a plurality of laminated dynodes, which multiplies the incident photoelectrons, an anode (positive electrode) of a net shape that collects the electrons multiplied by the electron multiplier section as an output signal, and a final-stage dynode (reversal dynode) of flat plate shape. Consequently, the photoelectrons emitted from the photoelectric surface are multiplied at the electron multiplier section, and are reflected at the final-stage dynode. Thereafter, the photoelectrons are collected as an output signal at the anode.

SUMMARY OF THE INVENTION

However, since the conventional photomultiplier tube has the structure as described above, there has existed the following problems in the conventional photomultiplier tube.

In the photomultiplier tube described above, since the final-stage dynode is formed in a flat plate shape, when alkali metal vapor is introduced to activate the photoelectric surface and the secondary electron emission layer of each dynode, the alkali metal vapor flows from the periphery of the photoelectric surface and each of the dynodes to the central regions and adheres thereto. As a result, the alkali metal layer is thick at the peripheral region for the photoelectric surface and for each of the dynodes and becomes thin at the central regions, and the output characteristics become non-uniform, depending on the position of the incident light. This is referred to as the degradation of the uniformity for the anode. Then, a method has been proposed that forms a plurality of through holes at the final-stage dynode, the pitch of which is substantially similar to that of the holes in the electronmultiplying holes of the dynodes, as has been disclosed in the Japanese Patent Application Laid Open No. 6-314550.

According to this method, as is disclosed in the Japanese Patent Application Laid-Open No. 59-151741, however, for multiplying the electrons at each stage of the dynodes in the photomultiplier tube of the type in which the electron distribution widens after being multiplied, when passage holes for the alkali metal vapor is provided at the final-stage dynode, a part of the electrons would slip out of the through holes. Consequently, not all of the electrons can be reflected efficiently at the final-stage dynode, and the output signal becomes small.

Furthermore, since the electron multiplier section tube is made up of multi-stage dynodes, when the size of the photomultiplier tube is small, for example, in case where the diameter of the sealed container is equal to 2 inches or smaller, the diameter of each of the dynodes themselves does not become too large, and rigidity can be possessed by itself. Therefore, the desired rigidity may be obtained, even in the case of assembling each of the dynodes before the formation of the electron multiplier section tube. Nevertheless, when the diameter of the sealed container becomes larger than 3 inches, each of the dynodes becomes large-sized, and dynodes themselves are prone to deformations, including twisting and bending; moreover, even for the case in which each dynode is assembled first to make the electron multiplier section, it is difficult to obtain the desired rigidity. Therefore, if left in this state, deformations due to heat are prone to occur at the time of the manufacturing of the photomultiplier tube, and there was the problem that it is difficult to ensure its characteristics constant.

The present invention has been presented so as to solve the above-mentioned problems, and in particular, is aimed at preventing deformations of the electron multiplier section tube, at the same time as providing a photomultiplier tube which is made to form a secondary electron surface having uniform characteristics.

A photomultiplier tube of the present invention is the one disposed in a sealed container, which comprises a photoelectric surface for generating electrons in accordance with the incidence of light; dynodes laminated in a plurality of stages inside this photoelectric surface, the dynodes multiplying the electrons emitted from the photoelectric surface; and an anode, and an anode which collects the electrons multiplied by the dynodes to output them as a signal. The anode is situated between the final-stage dynode of the dynodes and those dynodes excluding the final-stage dynode, and collects the multiplied electrons that are reflected by the final-stage dynode. Also, this photomultiplier tube is used to introduce the alkali metal vapor, at the time of the manufacturing of the photomultiplier tube, from the final-stage dynode of the sealed container to the side opposite to the light-receiving surface and is provided with alkali metal vapor inlet hole which is sealed thereafter. Furthermore, the final-stage dynode is formed from a plurality of layers each having numerous openings or slits that are located at specified locations on the electron reflecting surfaces; and partly behind each of the openings and slits of a first layer of said final-stage dinode there are effective reflecting surface sections of any following layers.

In this photomultiplier tube, open holes or slits are formed at each of the layers which constitute the final-stage dynode. These open holes or slits function as alkali metal vapor passage holes to introduce into each dynode the alkali vapor that was introduced via the alkali metal vapor inlet hole, at the time of formation of the photomultiplier tube. Thus, the alkali vapor is guided uniformly to the center of each dynode and its periphery. Furthermore, since after multi-layering of the final-stage dynode, portions which are not openings or slits of one of the layers beyond the second layer are arranged at the parts which correspond to the openings or the slits of the first layers, the multiplied electrons that passed through either the openings or the slits of the first layer, have a high possibility of colliding with the electron reflection surfaces of the succeeding layers, and as a consequence, the number of multiplied electrons that are allowed to pass through the final-stage dynode can be reduced.

Furthermore, setting effective reflecting surface sections of at least one following layer behind all of the openings and slits of the first layer, the multiplied electrons that reach the final-stage dynode can be reflected towards the anode, with certainty.

The final-stage dynode, in particular, consists of two layers each having a numerous slits of identical pitch and identical width; if the slit of the second layer were to be arranged between each of the slits located next to the first layer, then the first and the second layers can be identical in shape, so that the above-mentioned structure may be easily realized.

In addition, the dynode of each stage consists of a focusing mesh electrode of mesh shape that collects the electrons; a coarse mesh electrode having one or a plurality of first reinforcing bars bridged across the ends which become the outermost block of each dynode, the coarse mesh electrode having a secondary electron surface; and a spacer electrode having second reinforcing bars which mutually overlap with the first reinforcing bars. The focusing mesh electrodes may be such as to have a secondary electron emission section formed at the location corresponding to the first and the second reinforcing bars or the region close to that location.

This way, since each dynode is reinforced by the dynode reinforcing bars which are made up of the first and the second reinforcing bars, the structure can be preserved, which is strong against twisting and bending deformations of the dynodes due to heat and furthermore is excellent in vibration-resistance. On the other hand, furnishing dynode reinforcing bars at the dynode of each stage causes the secondary electrons not to be generated in the vicinity of the dynode reinforcing bars; and as this region would become then an insensitive region, and as a countermeasure, secondary electron emission section is provided on the focusing mesh electrodes. By taking this measure, the insensitive region is dissolved, and the output characteristics may be maintained uniform.

Furthermore, it is desirable that secondary electron emission surfaces be formed at each of the second reinforcing bars. By adopting such structure, the loss of the secondary electrons would not occur at the second reinforcing bars of the spacer electrodes, and electrons can be multiplied with good efficiency.

Moreover, the photomultiplier tube of the present invention further comprises a stem provided on a bottom surface of the sealed container, the stem having alkali metal vapor inlet hole; and a reinforcing plate arranged between the stem and the final stage dynode, the reinforcing plate having no openings at a position corresponding to the alkali metal vapor inlet hole and having specified openings at a periphery of that position. The reinforcing plate and all of the stages of the dynodes may be fixed, at least at a plurality of locations of the outer block section.

In this photomultiplier tube, since the entire electron multiplier section is reinforced by the reinforcing plate, the structure which is strong against twisting and bending of the electron multiplier section due to heating and is also good resistance to vibration can be ensured. When the secondary electron surfaces are formed in the electron multiplier section, the alkali metal vapor is injected inside the sealed container; the alkali metal vapor once collides at the non-opening sections of the reinforcing plate, due to the rectilinear character of the injected alkali metal vapor, then spreads to disperse outwardly along the plane of the reinforcing plate. Subsequently, in the course that the alkali metal vapor spreads along the surface of the reinforcing plate, the alkali metal vapor would leak from the openings provided at the reinforcing plate so as to disperse toward the electron multiplier section, whereby the alkali metal vapor is circulated uniformly at the electron multiplier section. As a result, a uniform secondary electron surface is formed at the electron multiplier section. In other words, although the reinforcing plate of such a structure is provided at a location which would make it a baffle plate, when the alkali metal vapor is injected into the sealed container, uniform dispersion of the alkali metal vapor is achieved by means of this reinforcing plate. Such a reinforcing plate structure is optimal for a large-sized photomultiplier tube of such size as 5 inches or 8 inches. Large-sized photomultiplier tubes are utilized in gamma cameras for medical treatment, where photographing such organ as the heart can be made at only one sitting with a single photomultiplier tube, without having to set numerous small photomultiplier tubes in arrays.

In this case, it is desirable to form the side tube of the sealed container out of metal. When such a construction is employed in producing the sealed container, since the junction of the metallic side tube and the stem can be achieved by high frequency welding, high temperature is never generated during the welding operation, so that the electron multiplier section inside the sealed container is never adversely effected on, when the stem and the reinforcing plate are close to. Accordingly, the side tube length may be shortened by the amount equivalent to the length, by which the stem and the reinforcing plate can be placed close to each other, and this would facilitate to make the size of the photomultiplier tube compact.

It is also desirable that the reinforcing plate possesses heat shielding property. When such a constitution is employed, since the heat generated at the time of joining the metal side tube and the stem may be shielded by the reinforcing plate, the heat conducted to the electron multiplier section can be shielded efficiently, and the effect on the electron multiplier section at the time of assembling can be reduced to an extremely low level.

On the other hand, the photomultiplier tube of the present invention may have the anode equipped at the location of the final-stage dynode, as in the various kinds of photomultiplier tubes described earlier, with a form similar to these final-stage dynodes.

According to this, along with the sure supplementing of the electrons which reach the anode, the formation of the secondary electron emission surfaces of the photomultiplier tube can be made uniform as well. The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF THE DRAWINGS

The present invention will be described in further detail with reference to the accompanying drawings, in which.

DETAILED DESCRIPTION OF THE PREFERRED EMBODIMENTS

Preferred embodiments of the photomultiplier tube according to the present invention will be explained in detail together with the drawings, in the following section.

Figure 1:
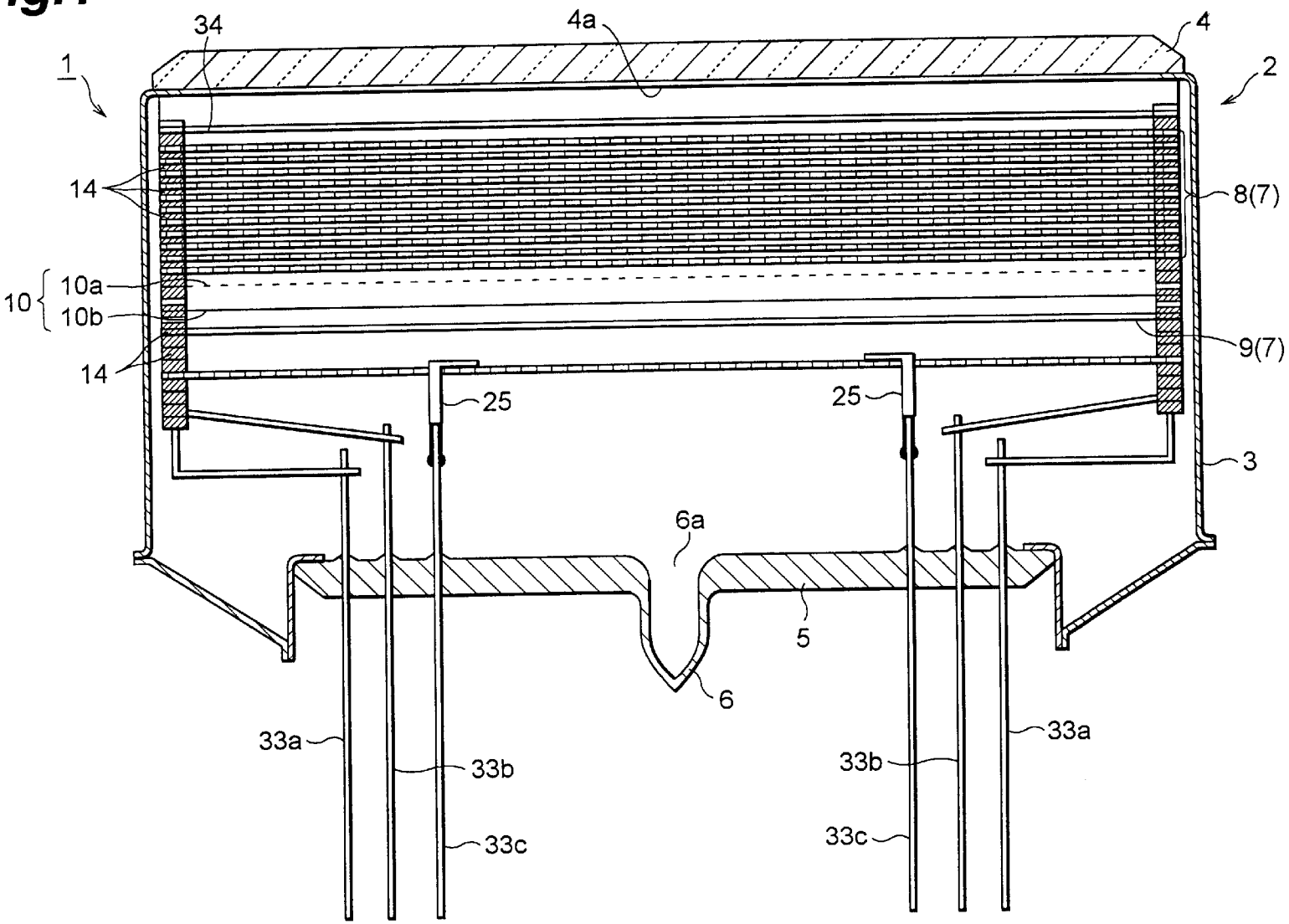
FIG. 1 shows a cross-sectional view indicating an embodiment of a photomultiplier tube according to the present invention.

FIG. 1 is a cross-sectional view showing the photomultiplier tube according to the present embodiment. Photomultiplier tube 1, shown in the same drawing, has a sealed container 2, and this sealed container 2 has a side tube made of a Kovar metal of cylindrical shape. A large-sized light-receiving surface plate 4 made of glass with about 8 inch diameter is fixed by means of high frequency welding, on top of this side tube 3, so as to block the upper end of side tube 3. Furthermore, in the lower section of the side tube 3, a stem 5 made of glass is fixed by high frequency welding, so as to block the lower opened end of the side tube 3. Then, a photoelectric surface 4*a* for generating photoelectrons by the incident light is formed on the inside surface of the light-receiving surface 4, and the tube 6 made of glass, used to inject the alkali metal vapor into the sealed container 2, is formed integrally with the stem 5 at the center of the stem 5.

An electron multiplier section 7, which is used to multiply the electrons from the photoelectric surface 4*a* in a multi-stage manner, is arranged in the sealed container 2. The electron multiplier section 7 consists of eleven sheets of circular plate dynodes 8 that have been laminated into 11 stages, and a final-stage dynode 9 (the reversal dynode) which is provided in the lower section of the eleventh stage dynode 8. Then, a specified voltage is applied to the dynode 8 of each stage and to the final-stage dynode 9 by a plurality of pins 33*a* which are arranged in a circular form, the pins 33*a* penetrating through the stem 5. Between the final dynode 9 and the eleventh stage 8, arranged is a crossed wire-type anode (positive electrode) 10 consisting of a plurality of X-anodes 10*a* and a plurality of Y-anodes 10*b* which are arranged in a matrix form. Each X-anode 10*a* and each Y-anode 10*b* are connected to a plurality of pins 33*b* which penetrate through the stem 5 and are arranged in a circular form, and by utilizing each of the pins 33*b*, the anode output is sent to external sections. In addition, reference numeral 34 denotes a ring-shape focusing electrode for focusing the photoelectrons which come from the photoelectric surface 4*a*.

Figure 2:
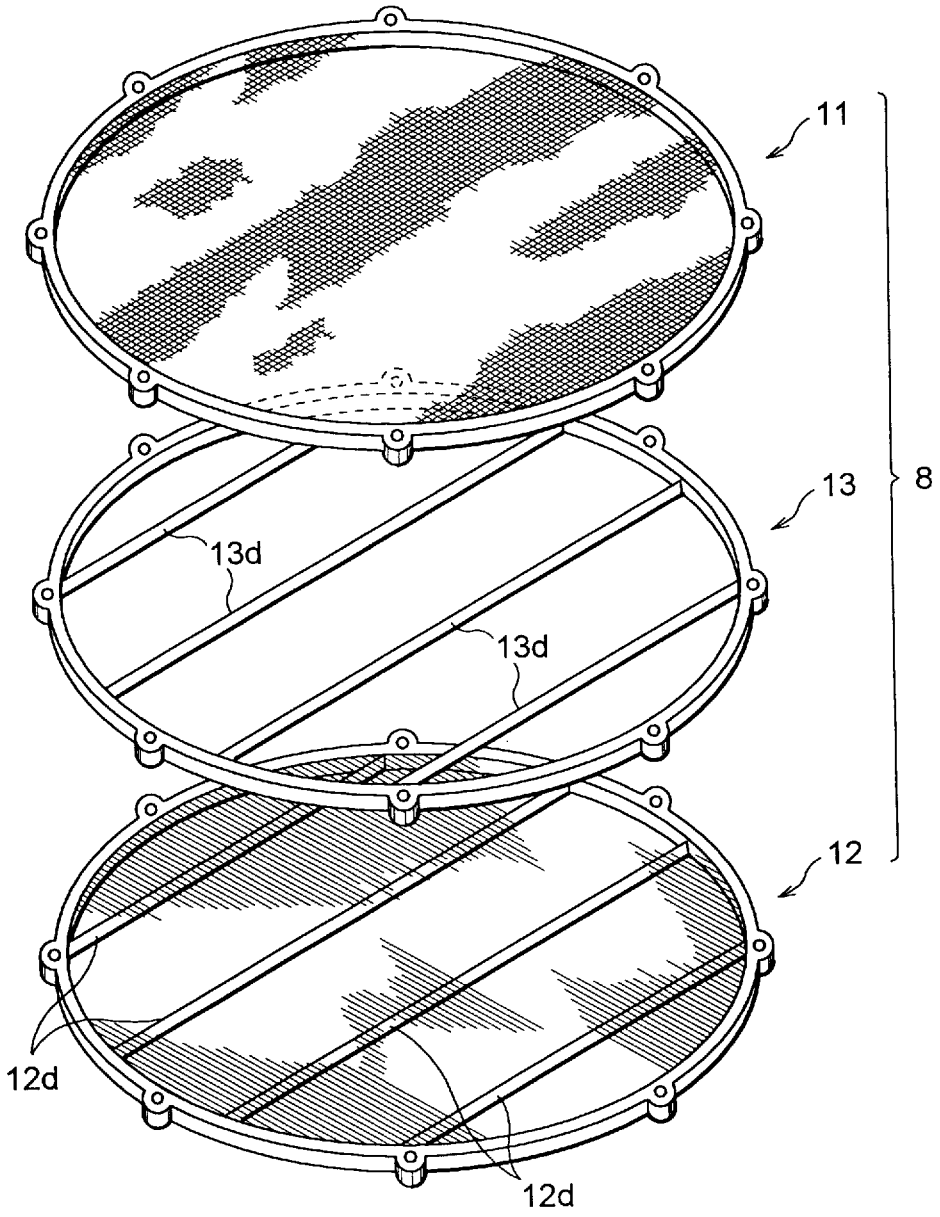
FIG. 2 is a perspective view showing the construction of each of the stages for the dynode of FIG. 1.
Figure 3A:
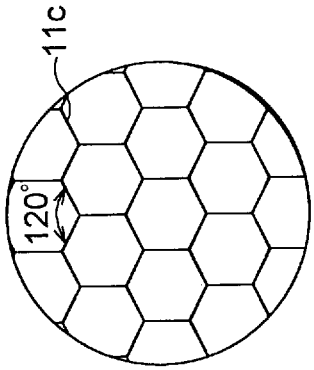
FIGS. 3 and 3A are a plan view showing a focusing mesh electrode of FIG. 2.
Figure 3:
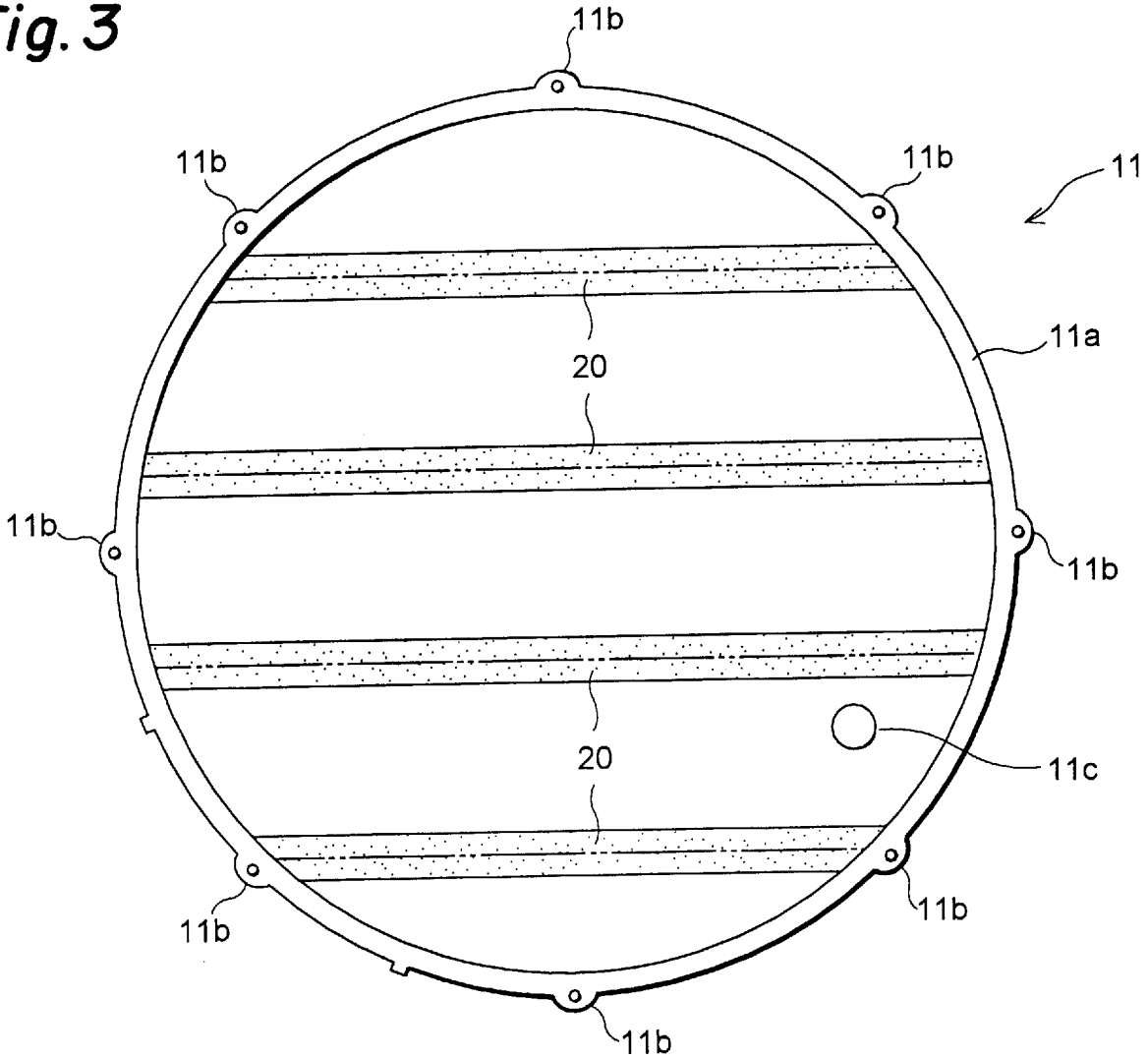
Figure 4:
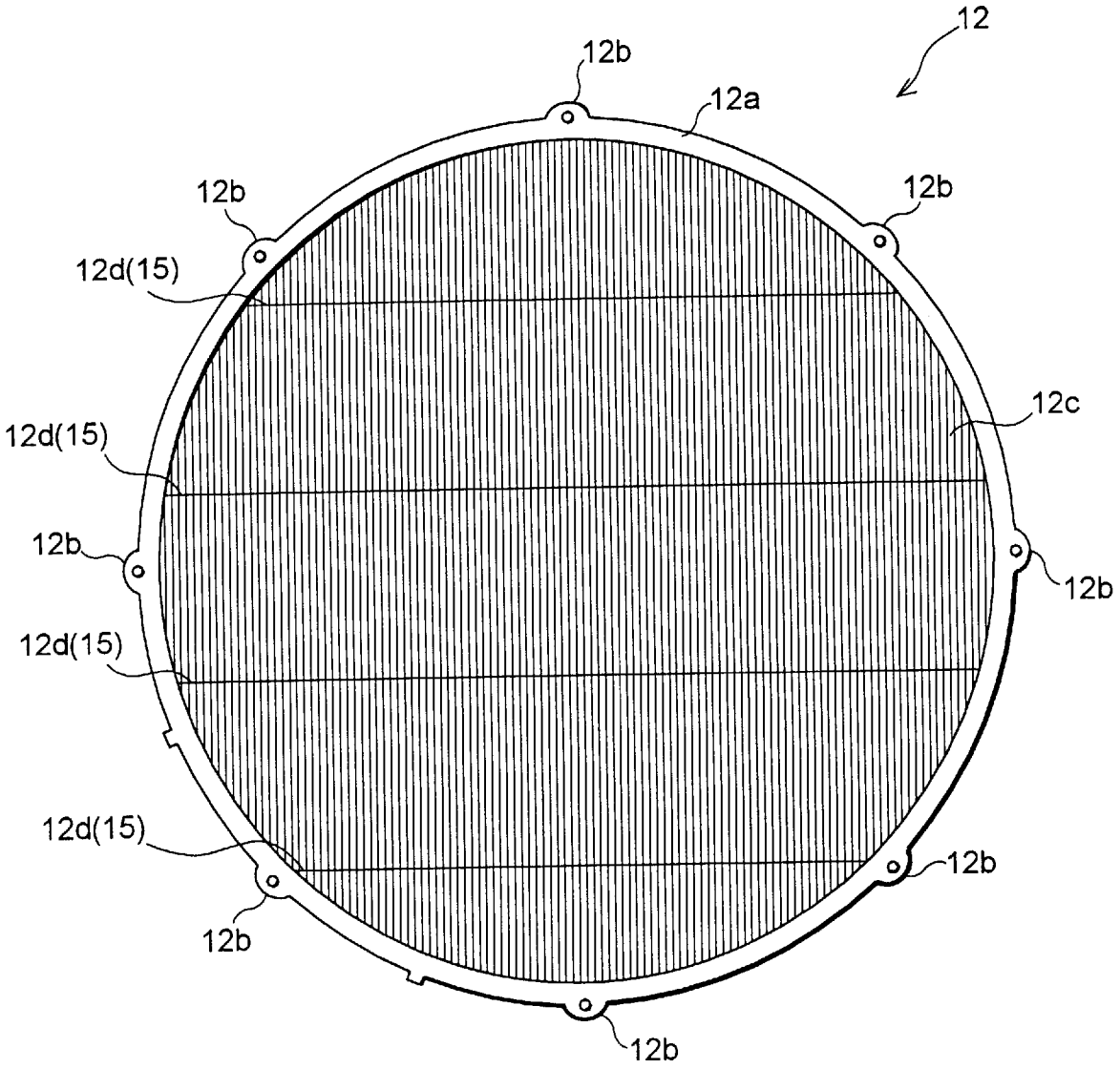
FIG. 4 is a plan view showing a coarse mesh electrode of FIG. 2.

As shown in FIG. 2, the dynode 8 of each stage consists of the focusing mesh electrode 11 that focuses the electrons, the coarse mesh electrodes 12 that has the secondary electron surfaces, and the spacer electrode 13 arranged between the focusing mesh electrode 11 and the coarse mesh electrode 12, which maintains the spatial interval between the electrodes 11 and 12. As shown in FIGS. 3 and 3A, the focusing mesh electrode 11 has the ring-shaped flange 11*a* of diameter about 200 mm and thickness of about 0.15 mm in its outermost block, and eight positioning lugs 11*b* are formed at equal intervals in the ring-shaped flange 11*a*. Furthermore, inside the ring-shaped flange 11*a* is a mesh 11*c* of honeycomb shape. As shown in FIG. 4, the coarse mesh electrode 12 has an ring-shaped flange 12*a* having diameter size identical to that of the focusing mesh electrode 11, with a thickness of about 0.2 mm, and eight positioning lugs 12*b* are formed at equal intervals in the flange 12*a*. Moreover, parallel meshes 12*c* are spread so as to be arranged inside the flange 12*a* at equal intervals.

Figure 5:
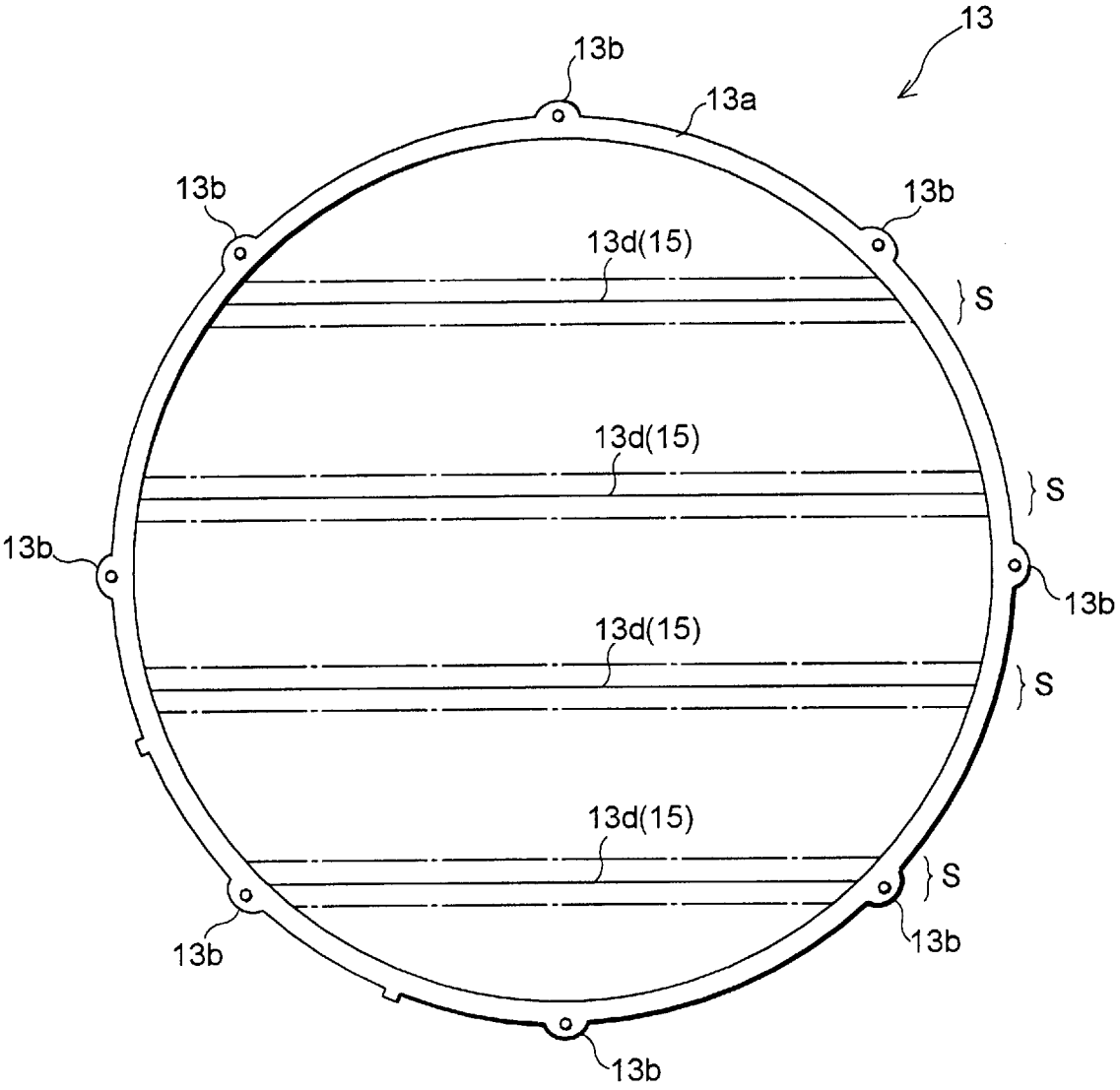
FIG. 5 is a plan view showing a spacer electrode of FIG. 2.

As shown in FIG. 5, the spacer electrode 13 have a ring-shaped flange 13*a* of the same diameter as that of the focusing mesh electrode 11 and the coarse mesh electrode 12. The ring-shaped flange 13*a* has a thickness of about 0.6 mm, and eight positioning lugs 13*b* are formed at equal intervals in the flange 13*a*. There may also be cases in which 2 sheets of the spacers 13 of thickness 0.3 mm are stacked.

Then, the spacer electrode 13 is nipped between the focusing mesh electrode 11 and the coarse mesh electrode 12. These electrodes 11, 12, and 13 are allowed to be conductive state, whereby a set of dynodes 8 making identical potentials possible are produced. At this time however, since the dynode 8 has a thin and a large ring body, the dynode 8 has a structure which is weak with respect to twisting and bending and is liable to produce deformations. Thus, four of the first reinforcing bars 12*d* are provided at the coarse mesh electrode 12, and each of the first reinforcing bars 12*d* are stretched on the inner side of the edge 12*a*, at equal intervals in the direction perpendicular to the parallel meshes 12*c*. Furthermore, in order to increase the strength of the dynode 8, four of the second reinforcing bars 13*d* are provided on the spacer electrode 13 as well. Each of the second reinforcing bars 13*d* is arranged so as to overlap each of the first reinforcing bars 12*d* of the coarse mesh electrode 12, and in assembling of the dynode 8, each of the second reinforcing bars 13*d* is welded to the respective first reinforcing bars 12*d*.

Figure 6:
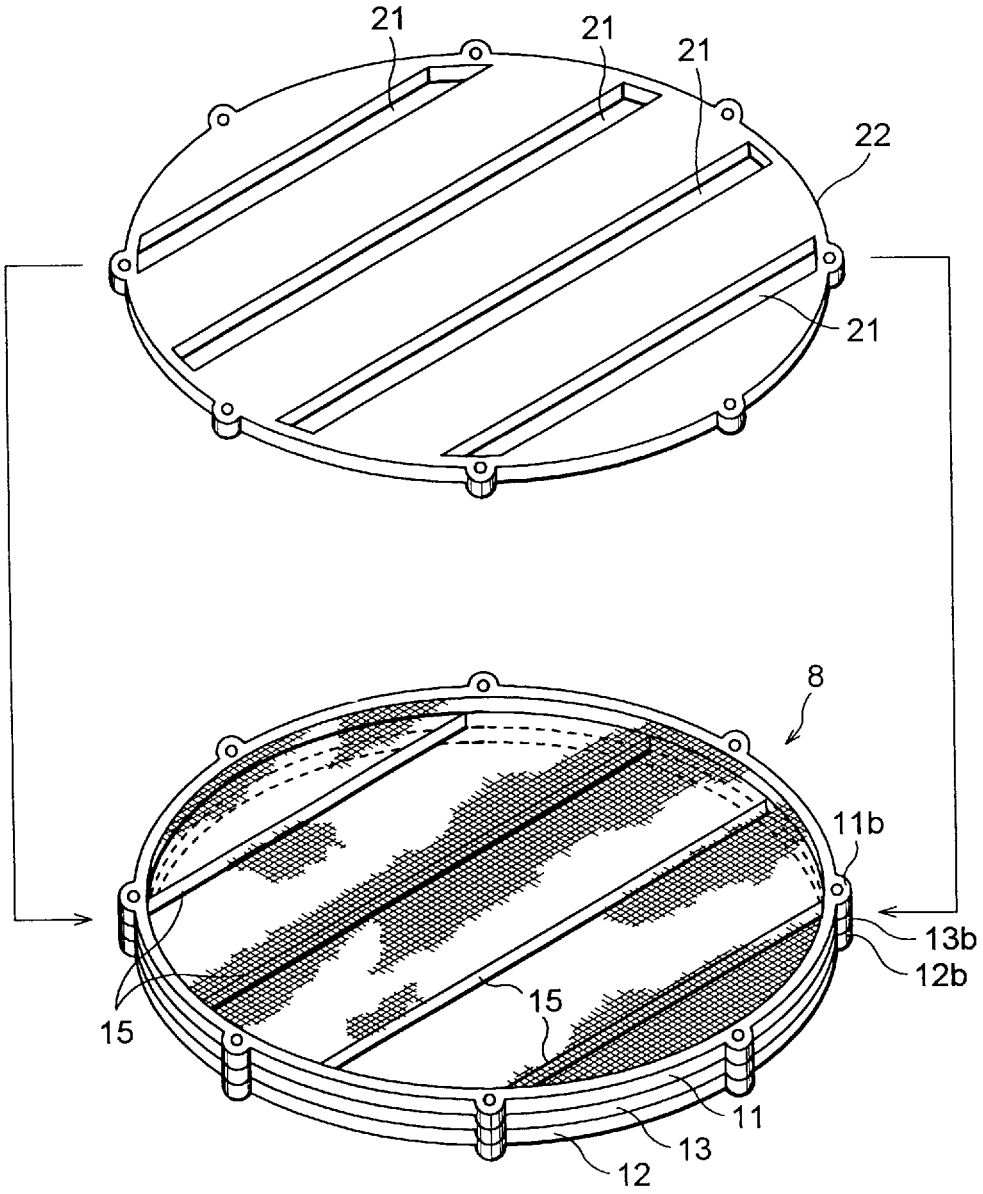
FIG. 6 is a perspective view showing a mask body for forming a secondary electron emission section for the focusing mesh electrode of FIGS. 3 and 3A.

As shown in FIG. 6, the dynode 8 of a set of three sheets which consists of the focusing mesh electrode 11, the coarse mesh electrode 12, and the spacer electrode 13 is assembled so as to align the respective lugs 11*b*, 12*b*, and 13*b*. Each dynode 8 is piled up in 11 stages above the anode 10, as shown in FIG. 1. In this case, by passing a connecting pin (not shown) through the lugs 11*b*, 12*b* and 13*b* of the dynodes 8, each dynode 8 is laminated in multi-stages while being positioned. Then, by interposing a ceramic cylindrical spacer 14 between each of the dynodes 8, the anodes 8 are electrically insulated from each other.

Moreover, when each dynode 8 is laminated in 11 stages upon another, dynodes of identical shape are used for each of the dynodes 8 in order to achieve a reduction in cost. They are piled up so as to shift by 90 degrees from each other. As a result, the four dynode reinforcing bars 15 composed of the first and second reinforcing bars 12*d* and 13*d* are arranged so that each of the bars 15 shifts by 90 degrees from the adjacent bar, and each of bars 15 is arranged in a matrix form when vied from the above (side of the light-receiving surface 4), at the electron multiplier section 7. Also, as shown in FIGS. 4 and 5, although the dynode reinforcing bars 15 are arranged at equal intervals, they are as a whole, pushed slightly to one side. Therefore, when 90 degree phase array for each dynode 8 is performed in the electron multiplier section 7, each dynode reinforcing bar 15 is orthogonal to each other, in relation to the stages that are adjacent to each other. They are parallel if compared by skipping one stage; moreover, in the case in which one stage is skipped, the reinforcing bars are separated by a specified interval when viewed from above (side of the light-receiving surface 4).

Figure 7:
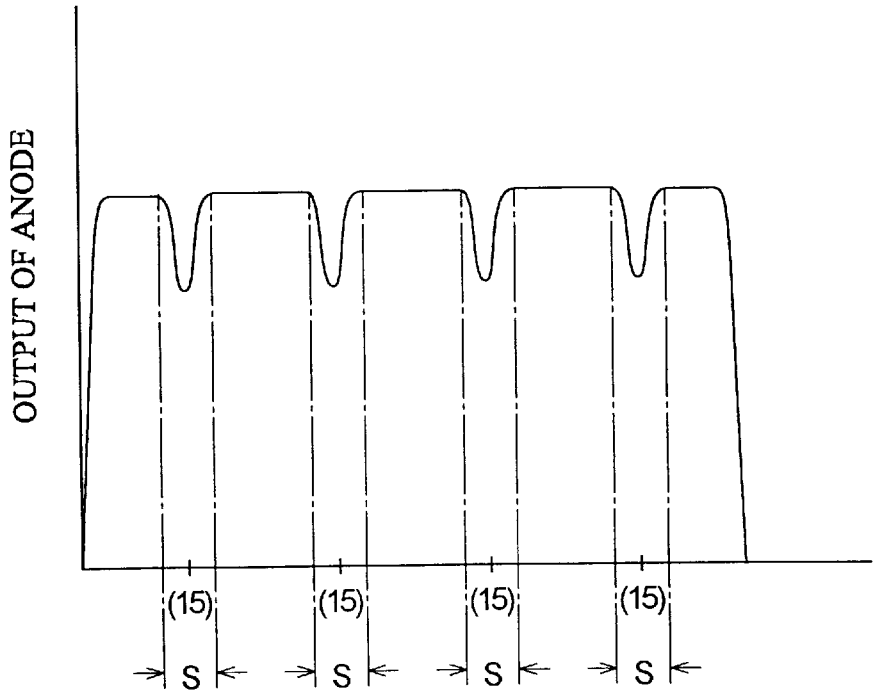
FIG. 7 is a graph showing an anode output when experiment is run with a condition in which no secondary electron emission section is formed in the focusing mesh electrodes.

Here, the previously mentioned dynode reinforcing bars 15 have been added for the reason why each of the dynodes 8 is thin and large-sized. When the secondary electrons disappear in this portion, the output of the anode 10 falls in the vicinity of each of the dynode reinforcing bars 15 as shown in FIG. 7, and the uniformity deteriorates due to the insensitive region S. Thus, in order to prevent lowering of the anode output by the dynode reinforcing bars 15, a secondary electron emission section 20 is provided (See FIG. 3) at the focusing mesh electrode 11, which corresponds the four insensitive regions S (refer to FIG. 5) formed in the peripheral section along the longitudinal direction of the dynode reinforcing bar 15. The method of forming this secondary electron emission sections is as follows: first, as shown in FIG. 6, by utilizing a mask body 22 having an opening 21 formed by notching the portion corresponding to the secondary electron emission section 20 by 5 mm width, the mask body 22 is placed on the focusing mesh electrode 11 of a set of the dynodes 8 so as to position the mask body 22 through the opening 21, antimony is externally deposited onto the dynode 8. Thus, the antimony is deposited onto the secondary electron emission sections 20 of the focusing mesh electrodes 11 and the dynode reinforcing bars 15. The antimony deposited in the above described manner reacts with alkali metal vapor introduced from the tube 6, after the assembling of the photomultiplier tube 1, and antimony produces the secondary electron surface.

Moreover, just above the dynode 8 of the first stage, auxiliary electrodes (not shown), on which antimony has been deposited previously, may also be arranged at the regions corresponding to the secondary electron emission sections 20. In this case, an internal deposition of antimony may adopted which is performed in such manner that by sending an electric current to the photomultiplier tube 1 after the assembling thereof, antimony on the auxiliary electrode is splashed to adhere it onto the secondary electron emission sections 20 of the focusing mesh electrodes 11 of the first stage.

Figure 8:
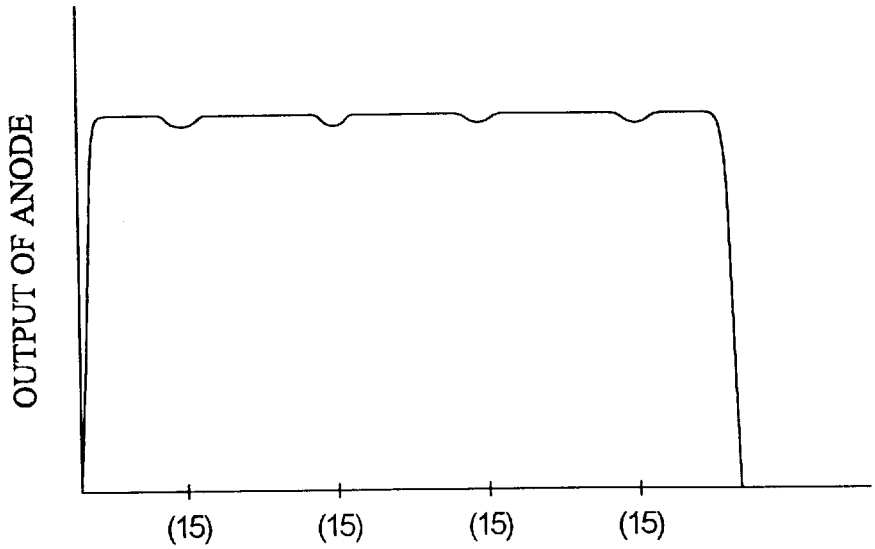
FIG. 8 is a graph showing the anode output when experiment is run with a condition in which secondary electron emission sections are formed in the focusing mesh electrodes.

Furthermore, the focusing mesh electrodes 11 which have the secondary electron emission sections 20 may be applied to any stage of the dynode 8; for example, they may be applied to the first and the second stages which are closest to the light-receiving surface plate 4 so as to cross the secondary electron emission sections 20 at the first and the second stages, or the secondary electron emission sections 20 may be applied at the first to third stages. In this way, a suitable selection of at which focusing mesh electrodes 11 the secondary electron emission sections 20 are provided depends on the characteristics of the photomultiplier tube 1; however, as is shown in FIG. 8, it is essential that uniform output of the anode 10 be ensured. In other words, it becomes necessary that the secondary electron emission sections generate the secondary electrons of enough quantity to compensate the sink in the output at the anode 10.

Figure 9:
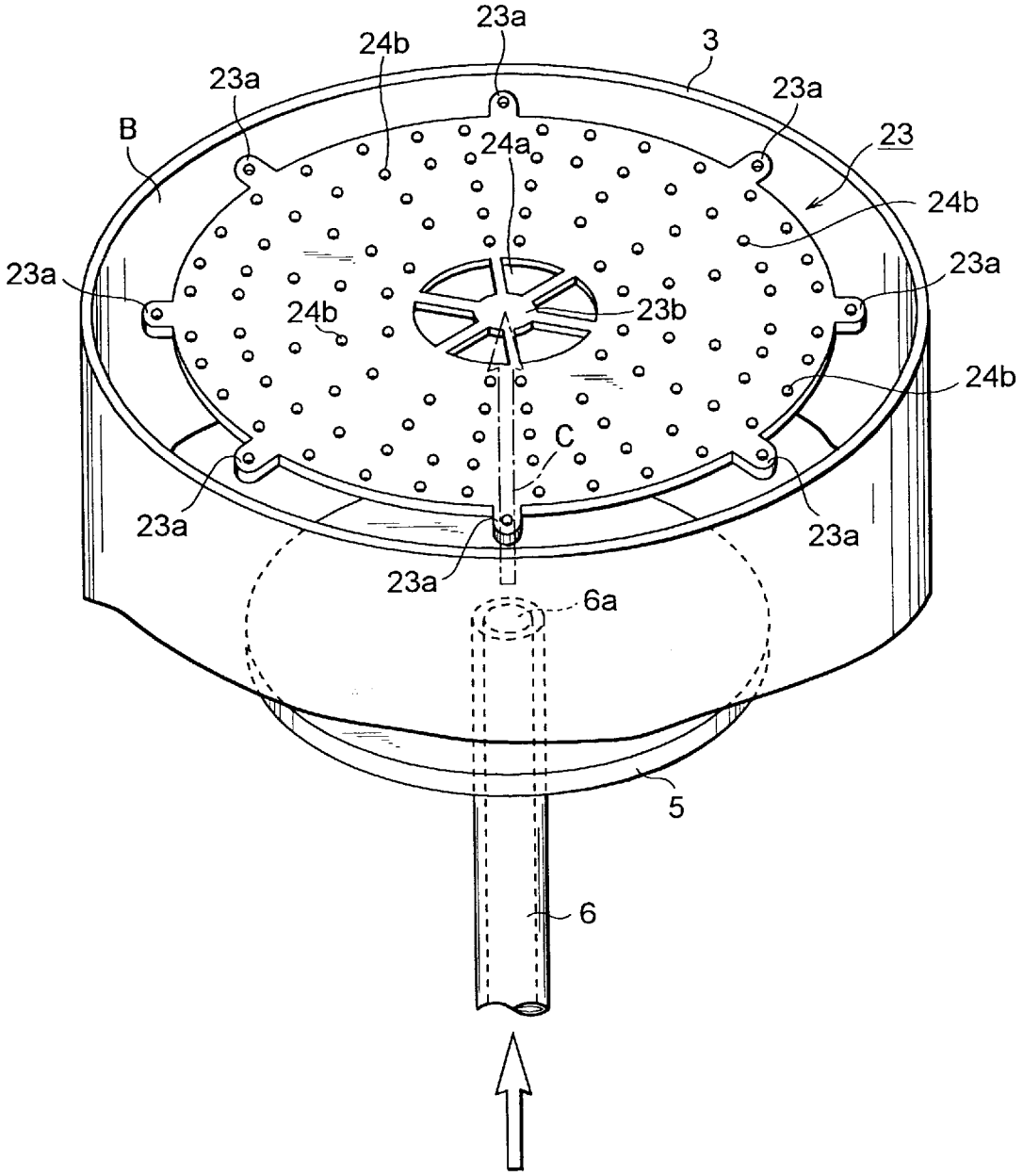
FIGS. 9 and 10 are a perspective view and a plan view, respectively, of the reinforcing plate of FIG. 1.

As is shown in FIGS. 1 and 9, in the interior of the sealed container 2, provided is a heat-shielding reinforcing plate 23 made of a circular plate with diameter of about 200 mm and about 0.7 mm thickness. This reinforcing plate 23 is arranged between the final-stage dynode 9 and the stem 5, and is fixed to the electron multiplier section 7 by eight positioning lugs 23*a* via the connecting pins (not shown) and the ceramic cylindrical spacers 14. The reinforcing plate 23 is fixed to the sealed container 2, by welding a plurality of lead pins 33*c* which rise from the stem 5 to the stainless steel supporting pillar pipes 25, one ends of which are fixed to the reinforcing plates 23. Consequently, reinforcement of the electron multiplier section 7 is made with certainty by the reinforcing plate 23 supported by the pillar pipes 25. Thus, a structure, which has a strong resistance to vibration and is not prone to twisting and bending of the electron multiplier section 7 due to heating, can be ensured.

Figure 10:
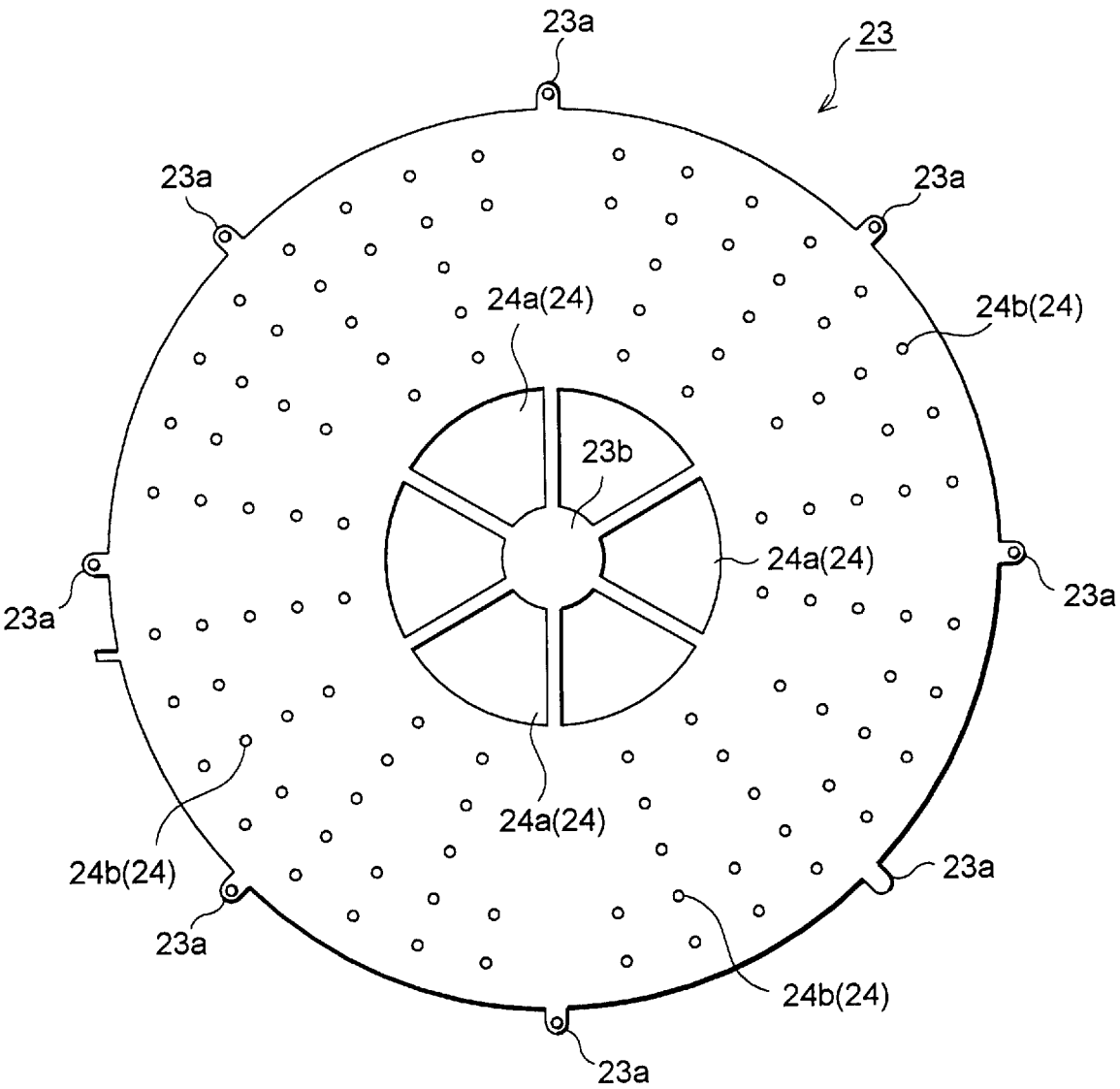

Furthermore, as is shown in FIGS. 9 and 10, in the reinforcing plate 23, the alkali metal vapor collision sections 23*b* of circular plate shape are formed, which face opposite to the alkali metal vapor exit 6*a* of the alkali metal vapor injection tube 6, the alkali metal vapor exit 6*a* being provided at the center of the stem 5. This alkali metal vapor collision section 23*b* has an area substantially equal to the area of opening of the alkali metal vapor exit 6*a*. Also, in the periphery of an alkali metal vapor collision section 23*b*, formed are alkali metal vapor dispersion holes 24 which make the alkali metal vapor flow uniformly towards the electron multiplier section 7. The alkali metal vapor dispersion holes 24 consist of first alkali metal vapor dispersion sections 24*a* arranged so as to enclose the alkali metal vapor collision section 23*b* and second alkali metal vapor dispersion holes 24*b* arranged radially in the outer area of the first alkali metal vapor dispersion holes 24*a*.

The first alkali metal vapor dispersion holes 24*a* are divided into six equal parts, each of which is formed in a sector shape; and each of the second alkali metal vapor dispersion holes 24*b* has a circular hole of identical size. Then, each of the first alkali metal vapor dispersion holes 24*a* has larger area of opening, compared to each of the second alkali metal vapor dispersion holes 24*b*. This is due to the annular gap B formed between the side tube 3, the reinforcing plate 23, and the electron multiplier section 7, in the sealed container 2. This is, therefore, a result of considering the fact that the alkali metal vapor injected into the evacuated sealed container 2 passes through the annular gap B, in order to squirt the alkali metal vapor uniformly out of the alkali metal vapor dispersion holes 24 of the reinforcing plate 23.

Thereupon, the alkali metal vapor is injected into the evacuated sealed container 2, in the direction of the arrow C via the tube 6, when the secondary electron surface is formed in the electron multiplier section 7; however, at this time, the alkali metal vapor spreads dispersing outwards along the plane of the reinforcing plate 23 because the alkali metal vapor injected via the tube 6 has a nature to advance straight, by once hitting the alkali metal vapor collision section 23*b* of the reinforcing plate 23. Then, while the alkali metal vapor spreads along the plane of the reinforcing plate 23, the alkali metal vapor squirts uniformly so as to diffuse from the first and second alkali metal vapor dispersion holes 24*a* and 24*b*, respectively, towards the electron multiplier section 7; and by a cooperative effect between the alkali metal vapor passage holes 30*b* and 31*b* (See FIG. 11) of the final-stage dynode 9, later described, the alkali metal vapor circulates uniformly inside the electron multiplier section 7. As a result, the alkali metal vapor and the antimony previously deposited on the electron multiplier section7 react, resulting in formation of a uniform secondary electron surface at the electron multiplier section 7 as well as a uniform photoelectric surface 4*a* at the light-receiving plate 4.

Thus, such a reinforcing plate 23 serves as a baffle plate by utilizing tube 6 at the time when the alkali metal vapor is injected into the sealed container 2. Uniform dispersion of the alkali metal vapor is achieved by providing alkali metal vapor dispersion holes 24*a* and 24*b* on this reinforcing plate 23. Photomultiplier tube 1 having such a structure is optimal for large-sized photomultiplier tube of size 5 or 8 inches, and photographing of organs such as heart can be made at a sitting with a single large-size photomultiplier tube 1, by utilizing the large-sized photomultiplier tube 1 in a gamma camera for medical use, without arranging numerous multiplier tubes side by side.

Also, when utilizing the reinforcing plate 23 in combination with the metallic side tube 3, joining of the metallic side tube 3 and the stem 5 can be achieved by high frequency welding at the time of assembling the sealed container 2. High heat is never generated during the welding operation; and no adverse effect is made on the electron multiplier section 7 inside the sealed container, even when the stem 5 and the reinforcing plate 23 are allowed to come close to each other. Hence, the side tube 3 may be shortened in proportion to that amount which permits the stem 5 and the reinforcing plate 23 to come closer, thus promoting the compactness for the photomultiplier 1. Furthermore, by bestowing heat shielding property to the reinforcing plate 23, the heat generated at the time of joining the metallic side tube 3 and the stem 5 can be shielded by the reinforcing plate 23, and efficient shielding of heat to be conducted to the electron multiplier section 7 is provided.

Next, the final-stage dynode 9 will be explained.

Figure 11:
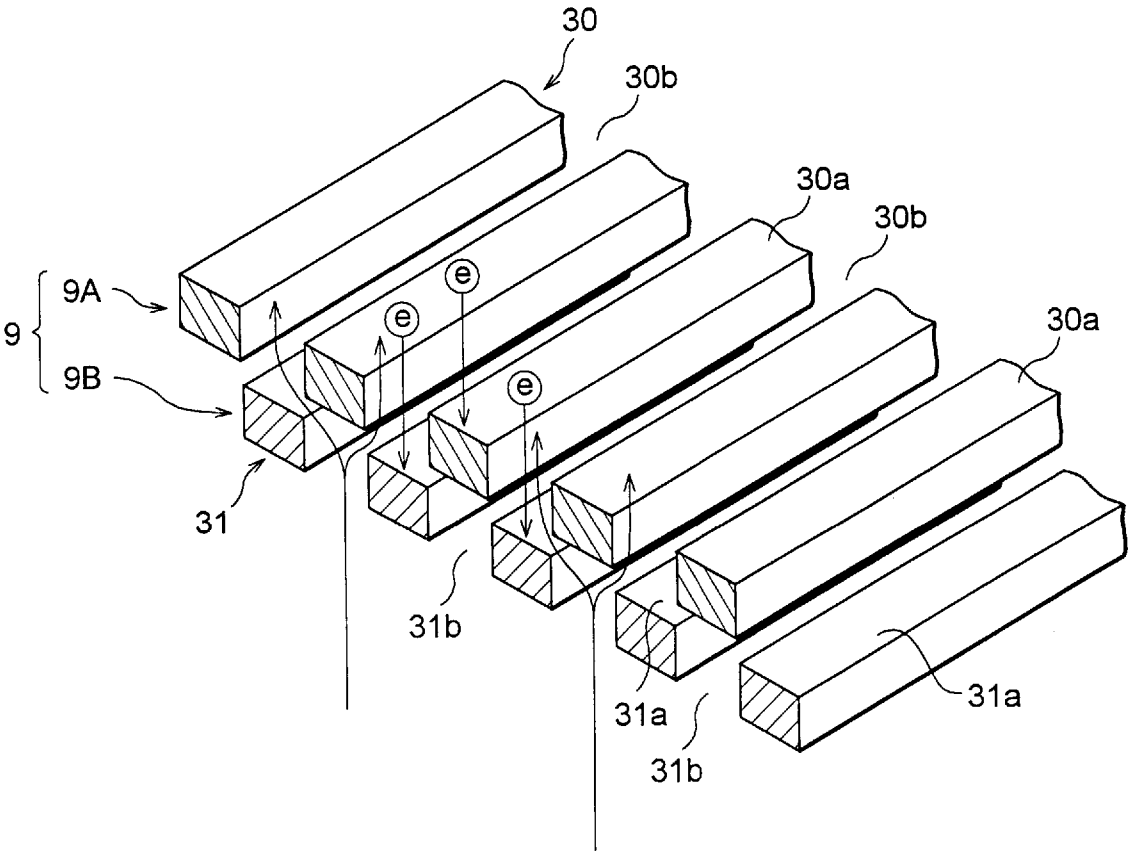
FIG. 11 is a perspective view showing a final-stage dynode made up of two layers of FIG. 1.
Figure 12:
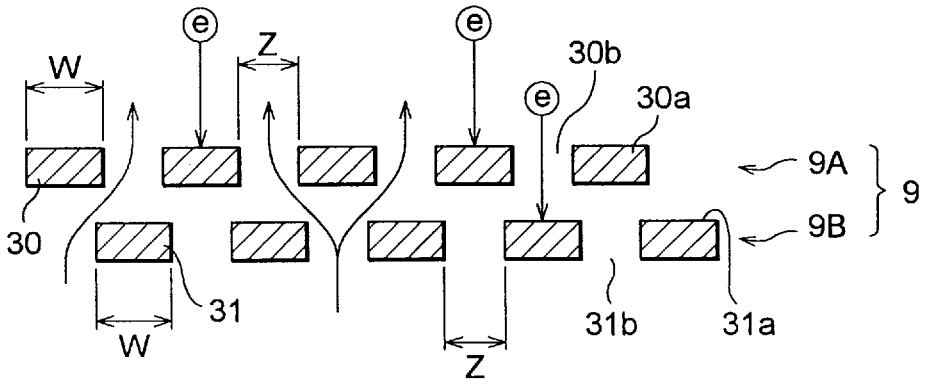
FIG. 12 and FIG. 13 are a cross-sectional view of FIG. 11 and a plan view of FIG. 11, respectively.
Figure 13:
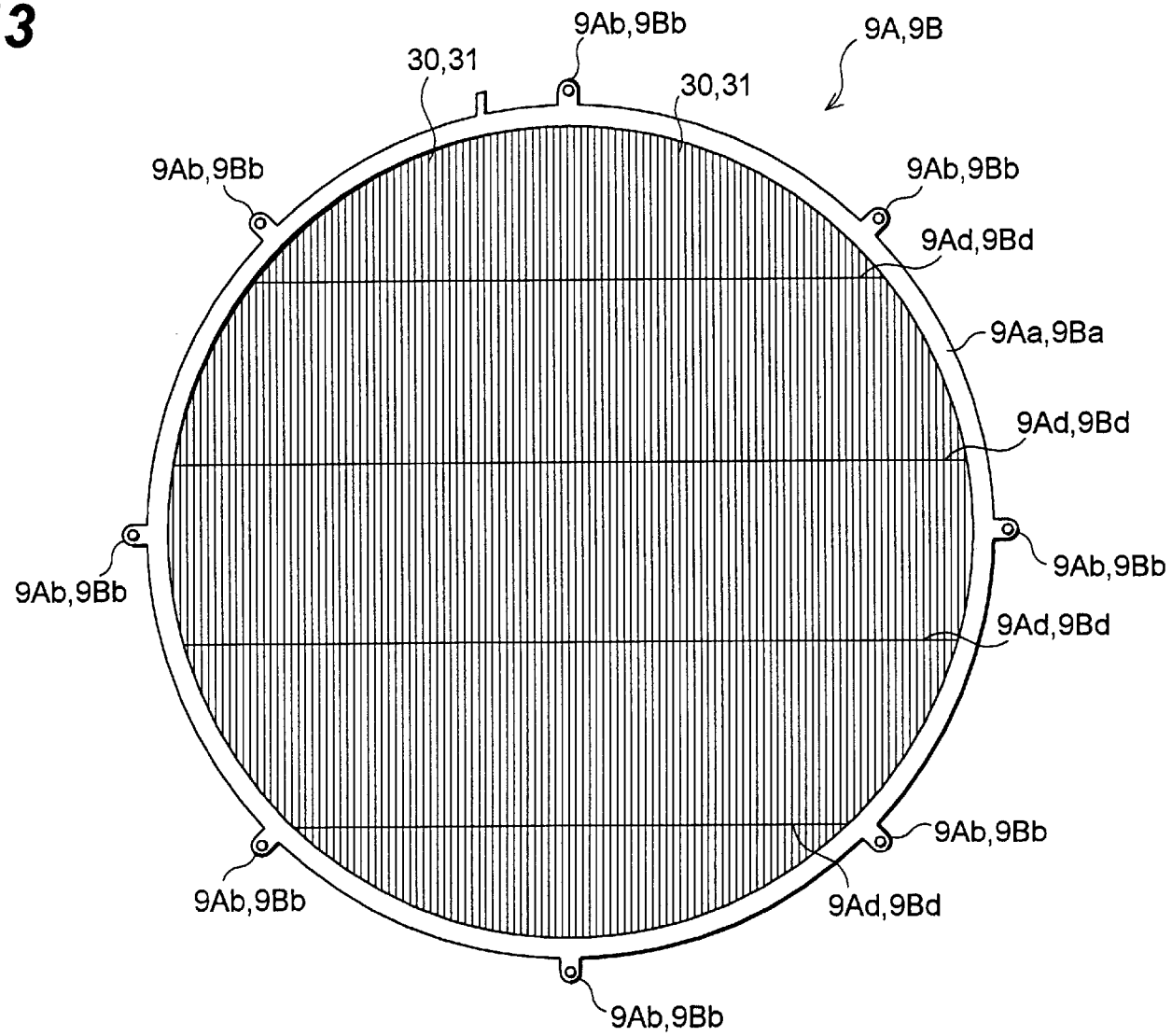

As shown in FIGS. 11 and 12, the final-stage dynode 9 consists of the two layers: the final-stage dynode 9A of the upper layer (the first layer) and a final-stage dynode 9B of the lower layer (the second layer), and these are separated by a ceramic cylindrical spacers 14 (See FIG. 1). As shown in FIG. 13, the final-stage dynode 9A of the upper layer has an ring-shaped flange 9A*a* having substantially the same diameter size as that of the focusing mesh electrode 11 and a thickness of about 0.3 mm. Eight positioning lugs 9A*b* are formed at equal intervals in the ring-shaped flange 9A*a*. Furthermore, parallel meshes 30 of rectangular cross section are stretched inside the ring-shaped flange 9A*a*. Since the final-stage dynode 9A of the upper layer is thin and of a large ring-shape body, it is thus weak against twisting and bending and prone to deformations. Hence, four pieces of reinforcing bars 9A*d* are provided at the final-stage dynode 9A, and each reinforcing bar 9A*d* is stretched at equal intervals in a direction orthogonal with respect to the parallel meshes 30, inside the ring-shaped flange 9A*a*.

Similarly, the final-stage dynode 9B of the lower layer has the same shape as that of the final-stage dynode 9A of the upper layer, as well as an ring-shaped flange 9B*a*, positioning lugs 9B*b*, parallel meshes 31, and reinforcing bars 9B*d*.

There, as shown in FIGS. 11 and 12, on the surface of the parallel meshes 30 which are located in the upper side, the electron reflecting surfaces 30*a* are formed to reflect the secondary electrons towards the anode 10. Alkali metal vapor passage holes 30*b* are formed between the parallel meshes 30, the holes 30*b* serving to pass the secondary electrons and the alkali metal vapor. Similarly, electron reflecting surfaces 31*a* are formed on the surface of the parallel meshes 31 located on the lower side, the electron reflecting surfaces 31*a* serving to reflect the secondary electrons towards the anode 10. Alkali metal vapor passage holes 31*b* are formed between the parallel meshes 31, in order to pass the alkali metal vapor.

The alkali metal vapor passage holes 30 of the final-stage dynode 9A of the upper layer and the electron reflecting surfaces 31*a* of the final-stage dynode 9B of the lower layer are placed facing opposite each other.

In addition, the pitch between the adjacent electron reflecting surfaces 30*a*, formed on the final-stage dynode 9A of the upper layer is set to be equal to the pitch between the adjacent electron reflecting surfaces 31*a*, formed on the final-stage dynode 9B of the lower layer. Moreover, the width Z of the alkali metal vapor passage holes 30*b* and 31*b* is made slightly smaller than the width W of the electron reflecting surfaces 30*a* and 31*a*. Therefore, by shifting the final-stage dynode 9B of the lower layer with respect to the final-stage dynode 9A of the upper layer by half a pitch, the secondary electrons which have been multiplied by the dynodes 8 of the electron multiplier section 7 can be reflected towards the anode 10, without leaks.

Furthermore, by separating the final-stage dynode 9A of the upper layer and the final-stage dynode 9B of the lower layer with the spacer 14, the alkali metal vapor flowing holes are not blocked so that they communicate. This results in formation of uniform alkali metal vapor flowing holes. As a consequence, the alkali metal vapor squirt out of the first and second alkali metal vapor passage holes 24*a* and 24*b*, respectively, of the reinforcing plate 23, whereby the alkali metal vapor can be uniformly sent into towards the dynodes 8 of eleven stages.

It is sufficient that the electron reflecting surfaces 31*a* of the final-stage dynode of the lower layer 9B have at least the width Z for capturing the electrons passing through the alkali metal vapor passage holes 30*b* of the final-stage dynode 9A of the upper layer. The pitch between the adjacent electron reflecting surfaces 30*a* formed on the final-stage dynode 9A of the upper layer need not be equal to the pitch between the adjacent electron reflecting surfaces 31*a* formed on the final-stage dynode 9B of the lower layer. In addition, although the shape of the cross-sectional plane of the parallel meshes 30 and 31 may be either trapezoidal or triangular, it is necessary that the anode 10 be arranged parallel, with respect to the electron reflecting surfaces 30*a* and 31*a*.

The case with two layers was explained in the above explanation, however, a structure having three or more layers may be made as well. In this case, it is sufficient that either of the layers beyond the second layer be arranged so as to block the holes of the first layer, and that either or more than two layers becoming identical in arrangement is not hindered.

Furthermore, the electron reflecting surfaces beyond the second layer need not completely block the alkali metal vapor holes of the first layer, but it is then desirable that a greater part be blocked.

And the final-stage dynode may be a transmitting type rather than the reflecting type, which has an anode arranged in the back of the dynode, the anode having a structure similar to the above-described final-stage dynode.

Although the present invention has been fully described by way of the preferred embodiments thereof with reference to the accompanying drawings, various changes and modifications will be apparent to those having skills in this field. Therefore, unless these changes and modifications otherwise depart from the scope of the present invention, they should be construed as included therein.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application Nos. 8-255067 (255067/1996), 8-255074 (255074/1996) and 8-255078 (255078/1996) all filed on Sep. 26, 1996 are hereby incorporate by reference.

What is claimed is:

1. A photomultiplier tube comprising a photoelectric surface to generate electrons in response to the light incident, dynodes arranged inside the photoelectric surface so as to be stacked in a plurality of stages to multiply electrons emitted from said photoelectric surface, and an anode or anodes to collect the electrons multiplied by said dynodes and to output as a signal, in a sealed container, said photomultiplier further comprising:

an alkali metal vapor inlet hole on an opposite side to a light-receiving surface in said sealed container, being used to introduce alkali metal vapor at the time of manufacturing of said photomultiplier tube and sealed thereafter, and wherein:

said anode or anodes is/are arranged between a final-stage dynode of said dynodes and dynodes excluding the final-stage dynode, to collect multiplied electrons reflected at the final-stage dynode;

said final-stage dynode is formed of a plurality of layers each having numerous openings or slits at specified locations on its electron reflecting surface; and partly behind each of the openings and the slits of a first layer of said final-stage dynode there are effective reflecting surface sections of any following layers.

2. The photomultiplier tube according to claim 1, wherein behind all of the openings and slits of said first layer of said final-stage dynode, there are effective reflecting surface sections of at least one following layer.

3. The photomultiplier tube according to claim 1, wherein said final-stage dynode consists of two layers, with numerous slits of identical pitch and width provided in the first layer and the second layer, and the slits of the second layer are arranged between each of the adjacent slits of the first layer.

4. The photomultiplier tube according to claim 1, wherein the dynodes of each stage is consisted of a focusing mesh electrode in a mesh form that focus electrons, a coarse mesh having a secondary electron surface and having at least one reinforcing bar which bridges across a peripheral portion serving as the outermost block of each of said dynodes, and a spacer electrode having a second reinforcing bar that overlaps with said first reinforcing bar, said spacer being arranged between said focusing mesh electrode and said coarse mesh electrode; and wherein said focusing mesh electrode is provided with a secondary electron emission section at a location corresponding to said first and second reinforcing bars and at peripheral regions thereof.

5. The photomultiplier tube according to claim 4, wherein a secondary electron emission surface is formed on each of said secondary reinforcing bars.

6. The photomultiplier tube according to claim 1, said photomultiplier tube further comprising:

a stem having said alkali metal vapor inlet provided on a bottom surface of said sealed container; and a reinforcing plate disposed between said final-stage dynode and said stem, positions thereof corresponding to said alkali metal vapor inlet hole being unopened and their periphery is provided with specified openings, and wherein said reinforcing plate and all stages of said dynodes are fixed, at least in a plurality of positions of its outer block section.

7. The photomultiplier tube according to claim 6, said photomultiplier tube further comprising:

a fixing member to fix said reinforcing plate and said sealed container.

8. A photomultiplier tube comprising a photoelectric surface to generate electrons in response to the light incident, dynodes arranged inside the photoelectric surface so as to be stacked in a plurality of stages to multiply electrons emitted from said photoelectric surface, and anodes to collect the electrons multiplied by said dynodes and to output as a signal, in a sealed container, said photomultiplier further comprising:

an alkali metal vapor inlet hole on an opposite side to a light-receiving surface in said sealed container, being used to introduce alkali metal vapor at the time of manufacturing of said photomultiplier tube and sealed thereafter, and wherein:

said anodes, formed of a plurality of layers each having numerous openings or slits at specified locations on its electron receiving surface, are arranged at far side of a light-receiving surface than said dynodes, and partly behind each of the openings and the slits of a first layer of said anodes there are effective reflecting surface sections of any following layers.

9. The photomultiplier tube according to claim 8, wherein behind all of the openings and slits of said first layer of said anodes, there are effective receiving surface sections of at least one following layer.

10. The photomultiplier tube according to claim 8, wherein said anodes consists of two layers, with numerous slits of identical pitch and width provided in the first layer and the second layer, and the slits of the second layer are arranged between each of the adjacent slits of the first layer.

11. The photomultiplier tube according to claim 8, wherein the dynodes of each stage is consisted of a focusing mesh electrode in a mesh form that focus electrons, a coarse mesh having a secondary electron surface and having at least one reinforcing bar which bridges across a peripheral portion serving as the outermost block of each of said dynodes, and a spacer electrode having a second reinforcing bar that overlaps with said first reinforcing bar, said spacer being arranged between said focusing mesh electrode and said coarse mesh electrode; and wherein said focusing mesh electrode is provided with a secondary electron emission section at a location corresponding to said first and second reinforcing bars and at peripheral regions thereof.

12. The photomultiplier tube according to claim 11, wherein a secondary electron emission surface is formed on each of said secondary reinforcing bars.

13. The photomultiplier tube according to claim 8, said photomultiplier tube further comprising:

a stem having said alkali metal vapor inlet provided on a bottom surface of said sealed container; and a reinforcing plate disposed between said anodes and said stem, positions thereof corresponding to said alkali metal vapor inlet hole being unopened and their periphery is provided with specified openings, and wherein said reinforcing plate and all stages of said dynodes are fixed, at least in a plurality of positions of its outer block section.

14. The photomultiplier tube according to claim 13, said photomultiplier tube further comprising:

a fixing member to fix said reinforcing plate and said sealed container.

* * * * *